United States Patent [19]

Schwab

[11] Patent Number: 4,845,751

[45] Date of Patent: Jul. 4, 1989

[54] WIRELESS STEREO HEADPHONE

[76] Inventor: Brian H. Schwab, 6596 Woodthrush Hill, Orlando, Fla. 32810

[21] Appl. No.: 169,014

[22] Filed: Mar. 16, 1988

[51] Int. Cl.[4] ..... H04R 5/02

[52] U.S. Cl. ..... 381/25; 455/352; 455/151; 455/161; 381/74

[58] Field of Search ..... 455/151, 161, 352; 381/25, 74, 105

[56] References Cited

U.S. PATENT DOCUMENTS

| | | | |
|---|---|---|---|
| D. 212,003 | 8/1968 | Roberts | D26/14 |
| D. 212,005 | 8/1968 | Roberts | D26/14 |
| D. 215,661 | 8/1969 | Richards | D26/14 |
| 3,906,160 | 9/1975 | Nakamura et al. | 381/25 |
| 3,934,201 | 1/1976 | Majefski | 381/14 |

FOREIGN PATENT DOCUMENTS

| | | | |
|---|---|---|---|
| 2554657 | 5/1985 | France | 455/89 |

*Primary Examiner*—Forester W. Isen

*Attorney, Agent, or Firm*—Richard L. Miller

[57] ABSTRACT

A wireless stereo headphone is provided that permits a user to listen to a stereo program being received by a conventional receiver/amplifier without the use of interconnecting wires. A transmitter contained within the headphones allows the user to remotely activate the SCAN and SEEK features of the receiver so that not only can he monitor a program and vary its volume, he can also select the program material.

2 Claims, 2 Drawing Sheets

WIRELESS STEREO HEADPHONE

BACKGROUND OF THE INVENTION

The instant invention relates generally to the field of accessories for audio receivers, and, more specifically to cordless devices for controlling their use.

At the current state of the art the movement of a headphone user is limited to the length of the cable connecting the headphone to a conventional receiver-/amplifier. This limitation restricts the user's freedom of movement, endangers his safety as he may trip on the cable, and electrically limits the distance he may be from the receiver/amplifier.

Some efforts have been made to provide a wireless headset but none have provided for remote control of such essential functions such as SCAN and SEEK. Without the ability to control these functions in particular, the user of a wireless headset may be able to monitor the output of a receiver/amplifier from some considerable distance but will be unable to make program selections. The SCAN function is used to scan the frequency spectrum for every detectable signal, while the SEEK function is typically used to locate either programmed stations or stations above some threshold signal level.

D. Kenney (U.S. Pat. No. 4,484,029) presents a cordless telephone switch and line selector, T. Lott (U.S. Pat. No. 4,493,950) presents a loudspeaker telephone, and K. Iwata (U.S. Pat. No. 4,654,883) presents a radio transmitter and receiver device having a headset with speaker and microphone; however none of these provides for the remote control of essential receiver/amplifier functions.

SUMMARY OF THE INVENTION

It is, therefore, a primary object of the instant invention to provide a wireless stereo headphone that can receive stereo signals at a considerable distance from a conventional receiver/amplifier.

A further object is to provide a wireless stereo headphone that can remotely control the SCAN and SEEK functions of a conventional receiver/amplifier with only a minor modification to the receiver amplifier.

A yet further object is to provide a wireless stereo headphone that uses an accessory plug-in transmitter that can be easily installed to a conventional receiver-/amplifier by simply plugging it into the receivers headphone jack.

A still further object is to provide a wireless stereo headphone that has simple controls to turn the unit on and off, control the volume, and control the SCAN and SEEK functions of the receiver/amplifier.

A still yet further object is to provide a wireless stereo headphone that is simple to use, inexpensive to manufacture, and rugged.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
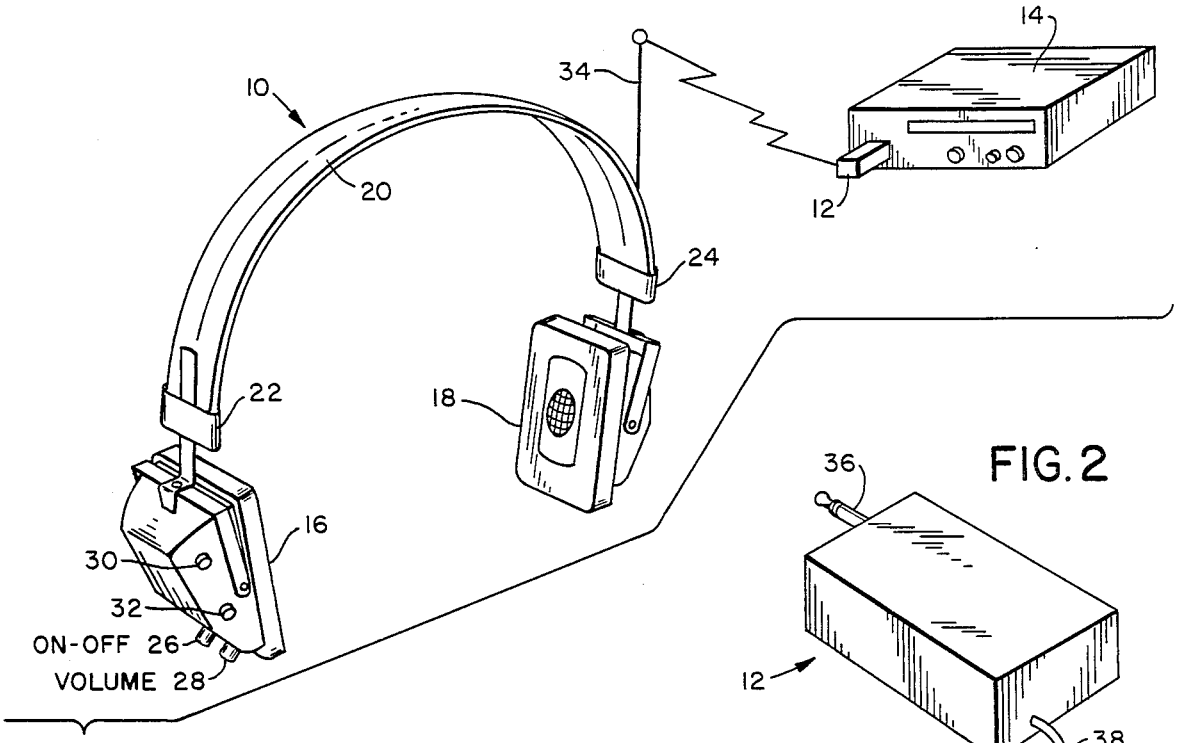
FIG. 1 is a perspective view of the cooperating parts of the instant invention.

The wireless stereo headphone, as shown in FIG. 1, has two main cooperating parts: the headset 10 and the accessory plug-in transmitter 12 shown plugged into conventional receiver/amplifier 14.

Figure 2:
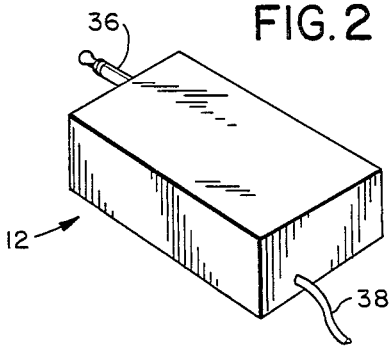
FIG. 2 is an enlarged perspective view of the of the plug-in accessory component of the invention.

As seen in FIGS. 1 and 2, headset 10 has a left padded earphone 16 and a right padded harpies 18, that are typically electromagnetic, although they may be electrostatic, or even piezoelectric. They are fitted with a headband 20 and are adjustable in position by adjusting sliding clips 22 and 24. Left earphone 16 is equipped with four controls: on/off switch 26, volume control 28, momentary contact SEEK switch 30 and momentary contact SCAN switch 32. A whip-type headphone antenna 34 is attached to right earphone 18.

As seen in FIG. 2, accessory plug-in transmitter module 12 has an integral multi-conductor phono plug 36 that plugs into the headphone jack of a conventional receiver/amplifier. A wire antenna 38 is also provided.

Figure 3:
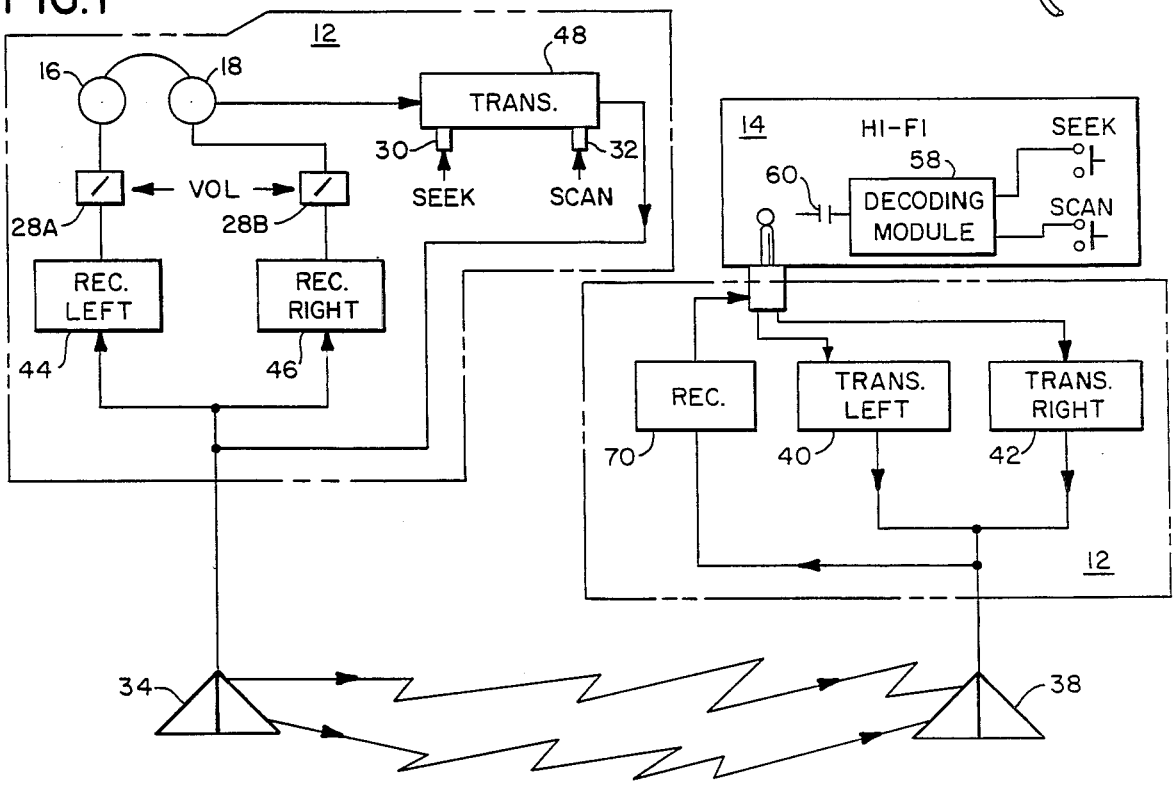
FIG. 3 is a block diagram of the instant invention.
Figure 4:
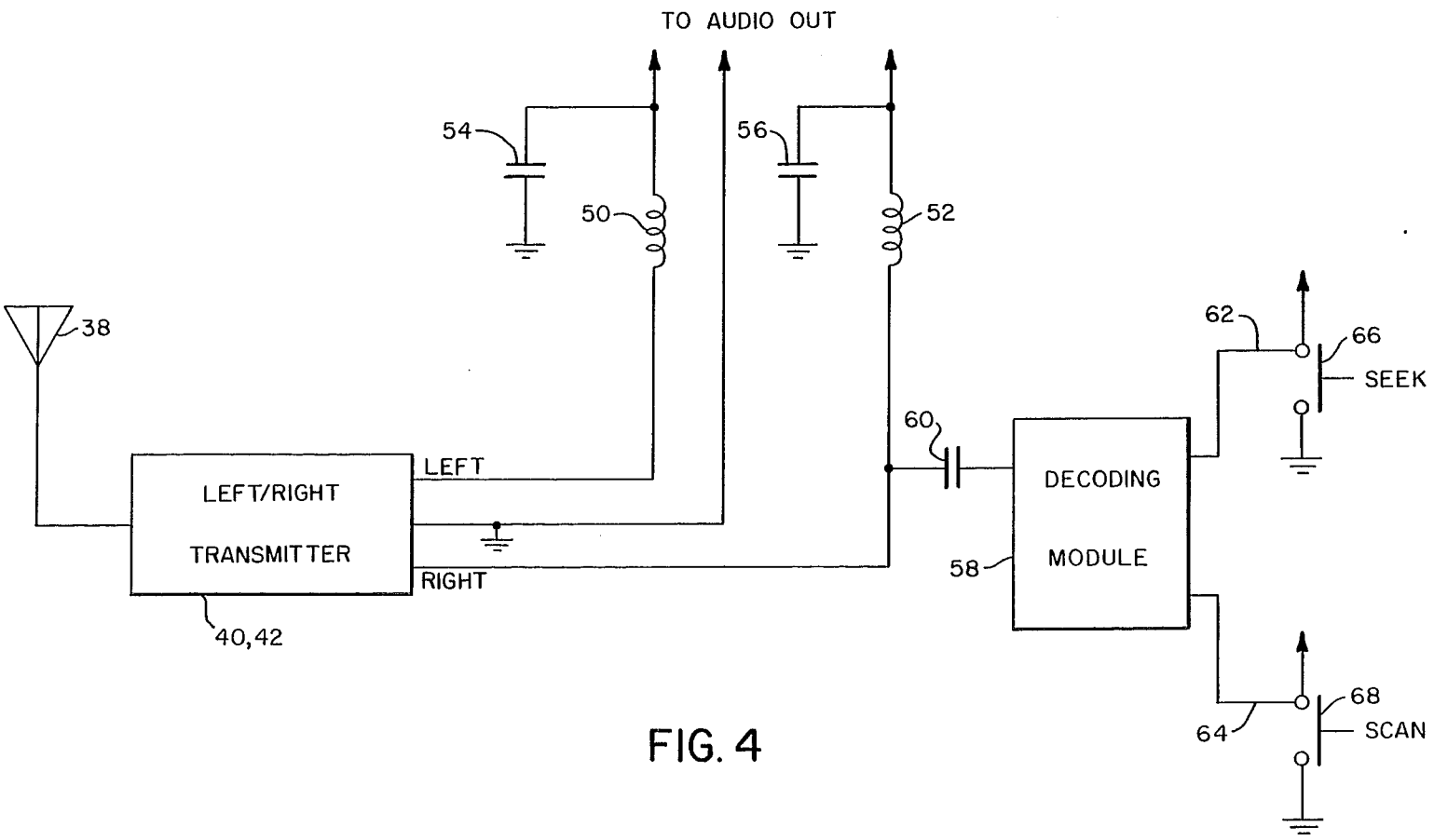
FIG. 4 is a partial block diagram showing the modifications needed to convert a conventional receiver/amplifier to permit remote control of the SCAN and SEEK functions.

The detailed electronic operation of the invention may best be understood with reference to FIGS. 3 and 4. Stereo audio from conventional receiver/amplifier 14 is coupled via three-conductor phono plug 36 to the accessory left/right stereo transmitter 40/42. These may be two separate transmitters operating on two discrete frequencies, or they may be a single transmitter with multiplexed channels both on the same frequency. The output of transmitters 40/42 is transmitted via accessory module antenna 38, a wire antenna.

This transmitted signal is intercepted by whip-like antenna 34 and is detected, demodulated, and amplified by left right headphone receivers 44/46 which may be two separate receivers operating on two discrete frequencies or they may be a single receiver receiving multiplexed signals. Left volume control 28A controls the audio output of left earphone 16, while right volume control 28B controls the audio output of right earphone 18.

To remotely operate the SCAN and SEEK function the user depresses either momentary contact SEEK switch 30 or momentary contact SCAN switch 32. Operation of these switches causes headphone transmitter 48 to output a uniquely encoded signal to headphone antenna 34. This signal may be intercepted by the plug-in module's antenna 38, amplified in optional receiver 70 and processed by appropriate circuitry contained in receiver/amplifier 14; Or in the alternative this signal may instead be passes through left/right transmitter 40/42 and into the conventional receiver/amplifier 14 through one of the channels. If the latter is the case than this radio frequency signal is superimposed upon one of the audio channels.

In FIG. 4 the modifications to the receiver/amplifier needed to allow remote control of the SCAN and SEEK functions to operate in the latter case. In order to decouple any radio frequency signals from the audio signals, which may or may not be a problem depending upon the design of the conventional receiver/amplifier, optional decoupling chokes 50 and 52 are provided, as well as bypass capacitors 54 and 56. The encoded radio frequency signals are coupled to decoding module 58 via coupling capacitor 60. The outputs of decoding module 58 are switched lines 62 and 64 that are connected across SEEK button 66 and SCAN button 68 which are typically found in conventional receiver/amplifiers. When a user depresses either SEEK switch 30 or SCAN switch 32 the conventional receiver/amplifiers SCAN and/or SEEK feature is activated.

It is to be further noted that decoding module 58, and receiver 70 may be contained either in plug-in accessory 12, or in receiver/amplifier 14, depending upon design choice of the manufacture.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A wireless stereo headphone comprising:

(a) a left and a right earphone;

(b) a stereo headphone receiver contained in said headphone wherein the left and right outputs of said stereo receiver are connected to said left and right earphones respectively;

(c) a headphone antenna connected to said stereo headphone receiver;

(d) a plug-in accessory stereo transmitter; an accessory antenna for said accessory transmitter; a housing for said accessory transmitter; and a stereo plug, wherein said plug protrudes from said housing, and is positioned in such a way as to allow said plug to be inserted into the headphone jack of conventional stereo receiver/amplifier having SEEK and SCAN functions; wherein the audio output of said conventional receiver/amplifier is transmitted from said accessory stereo transmitter to said stereo headphone receiver so that a user can listen to program material without being tied by a cable to said conventional receiver/amplifier; and (e) a headphone transmitter contained in said headphone, a momentary contact SEEK switch, and a momentary contact SCAN switch; wherein the depression of either of said switches causes a uniquely encoded signal to be transmitted via said headphone antenna; and means for decoding said encoded signal such that SEEK and SCAN functions in said conventional receiver/amplifier may be remotely controlled when the respective said momentary contact switches are depressed.

2. A wireless stereo headphone, as recited in claim 1, wherein said means for decoding said encoded signal comprises a decoding module whose input is said encoded signal, received via said accessory antenna; and whose output is a switching signal that goes from off to on when a user depresses said momentary contact SEEK switch, and a switching signal that goes from off to on when a user depresses said momentary contact SCAN switch, where said outputs are used to control the SEEK and SCAN functions of said conventional receiver/amplifier.

* * * * *